US007606637B2

(12) United States Patent
Habing

(10) Patent No.: US 7,606,637 B2
(45) Date of Patent: Oct. 20, 2009

(54) LAWN SPRINKLER PLAY APPARATUS

(75) Inventor: Theodore G. Habing, Tustin, CA (US)

(73) Assignee: Dream Visions, LLC, Tustin, CA (US)

( * ) Notice: Subject to any disclaimer, the term of this patent is extended or adjusted under 35 U.S.C. 154(b) by 22 days.

(21) Appl. No.: 11/498,394

(22) Filed: Aug. 1, 2006

(65) Prior Publication Data

US 2008/0033601 A1 Feb. 7, 2008

(51) Int. Cl.
*A63H 23/00* (2006.01)
*B05B 3/00* (2006.01)
*G05D 11/00* (2006.01)

(52) U.S. Cl. ..... 700/284; 239/19; 446/475

(58) Field of Classification Search ..... 700/283, 700/284; 239/16–19, 22, 23, 211, 536; 446/153, 446/475; 472/128
See application file for complete search history.

(56) References Cited

U.S. PATENT DOCUMENTS 1,717,709 A * 6/1929 Johnson ..... 239/288.5
3,801,014 A * 4/1974 Cantales ..... 239/104
D268,279 S * 3/1983 Geller et al. ..... D23/215
RE31,204 E * 4/1983 Sanner ..... 137/78.3
4,684,066 A * 8/1987 Uzrad ..... 239/229
4,820,265 A * 4/1989 DeSatnick et al. ..... 604/30
4,982,959 A 1/1991 Rudell et al.
4,985,638 A * 1/1991 Brock ..... 307/38
5,009,192 A * 4/1991 Burman ..... 119/720
5,278,749 A * 1/1994 De Man ..... 700/14
5,341,995 A * 8/1994 Leatch ..... 239/729
5,480,336 A 1/1996 Blanchard
5,649,867 A 7/1997 Briggs
5,683,314 A 11/1997 Musso
D399,915 S * 10/1998 McEachen ..... D23/214
5,820,472 A 10/1998 Briggs
5,826,803 A * 10/1998 Cooper ..... 239/556
5,878,956 A 3/1999 Djukastein et al.
5,918,809 A 7/1999 Simmons
6,050,501 A * 4/2000 O'Rourke ..... 239/229
D424,128 S * 5/2000 McEachen ..... D21/483
6,082,633 A 7/2000 Kephart et al.
6,095,927 A * 8/2000 Malone ..... 472/62
6,173,727 B1 * 1/2001 Davey ..... 137/1
6,459,959 B1 * 10/2002 Williams et al. ..... 700/284
6,491,062 B1 * 12/2002 Croft ..... 137/624.11
6,582,055 B1 7/2003 Marino
6,652,188 B1 * 11/2003 Albright et al. ..... 405/37
6,691,790 B1 * 2/2004 MacDonald et al. ..... 169/16
6,772,050 B2 * 8/2004 Williams et al. ..... 700/284
6,810,910 B2 * 11/2004 McHugh ..... 137/601.16
6,905,388 B2 * 6/2005 Schoonmaker ..... 446/153
6,997,642 B2 * 2/2006 Bishop, Jr. ..... 405/37
7,140,557 B2 * 11/2006 Theron ..... 239/229
7,216,659 B2 * 5/2007 Caamano et al. ..... 137/1

(Continued)

*Primary Examiner*—M. N. Von Buhr
(74) *Attorney, Agent, or Firm*—Blakely, Sokoloff, Taylor & Zafman LLP

(57) ABSTRACT

A sprinkler play system has a central distribution station and a plurality of sprinkler stations. The sprinkler stations may be spaced apart on a lawn. The sprinkler stations are connected to the distribution station with flexible water conduits. Each of the sprinkler stations includes a low voltage solenoid valve. Electrical conductors may be included with the flexible water conduits in order to operate the solenoid valves. A control unit permits selective activation of the individual sprinkler stations.

14 Claims, 3 Drawing Sheets

U.S. PATENT DOCUMENTS

| | | | | |
|---|---|---|---|---|
| 7,225,058 | B1 * | 5/2007 | Porter | 700/284 |
| 7,286,904 | B2 * | 10/2007 | Graham | 700/284 |
| 7,289,886 | B1 * | 10/2007 | Woytowitz | 700/284 |
| 7,406,363 | B2 * | 7/2008 | Doering et al. | 700/284 |
| 2002/0042660 | A1 * | 4/2002 | Atkinson | 700/65 |
| 2002/0068502 | A1 * | 6/2002 | Kownacki | 446/465 |
| 2002/0166986 | A1 * | 11/2002 | Remby et al. | 251/129.04 |
| 2004/0015270 | A1 * | 1/2004 | Addink et al. | 700/284 |
| 2004/0089346 | A1 * | 5/2004 | Sutardja | 137/377 |
| 2004/0221817 | A1 * | 11/2004 | Hatfield | 119/74 |
| 2005/0167625 | A1 * | 8/2005 | Deen | 251/129.04 |
| 2006/0024343 | A1 * | 2/2006 | Wilkins | 424/405 |
| 2006/0041655 | A1 * | 2/2006 | Holloway et al. | 709/223 |
| 2006/0157580 | A1 * | 7/2006 | Regli | 239/67 |
| 2006/0181406 | A1 * | 8/2006 | Petite et al. | 340/521 |
| 2008/0039978 | A1 * | 2/2008 | Graham | 700/284 |
| 2008/0041321 | A1 * | 2/2008 | Jong et al. | 119/719 |
| 2008/0186166 | A1 * | 8/2008 | Zhou et al. | 340/539.13 |

* cited by examiner

LAWN SPRINKLER PLAY APPARATUS

BACKGROUND OF THE INVENTION

1. Field of the Invention

This invention relates to the field of amusement devices and, more particularly, to a children's play apparatus having a plurality of remotely operated water sprinklers.

2. Background

Children enjoy water play, particularly in hot weather. It is a common sight to see children playing in and around lawn sprinklers during the summer months. Various devices that functionally resemble conventional lawn sprinklers have been designed specifically for amusement purposes. Examples of such devices can be seen in U.S. Pat. Nos. 5,480,336; 5,649,867; 5,820,472; 6,082,633 and 6,592,055. These devices have multiple spray heads or orifices, all of which spray at the same time. U.S. Pat. No. 5,683,314 shows a device with multiple spray heads in which the flow of water through a head may be turned on or off by the pressure of standing on the spray head. U.S. Pat. No. 4,982,959 shows a water sprinkler mat game with spray orifices placed at various locations on a mat defining a playing surface. U.S. Pat. No. 5,878,956 shows a motion activated water sprinkler that turns on for a period of time in response to the detection of movement. U.S. Pat. No. 5,918,809 shows a floating fountain display that moves to different position in the water and includes a valve system for spraying water through different nozzles.

SUMMARY OF THE INVENTION

The present invention provides a sprinkler play apparatus that has a central distribution station and a plurality of sprinkler stations. The sprinkler stations may be spaced apart on a lawn. The sprinkler stations are connected to the distribution station with flexible water conduits. A control unit permits selective activation of the individual sprinkler stations.

The sprinkler stations may be electrically activated with low voltage solenoid valves, which may be located within each sprinkler station itself. Electrical conductors may be included with the flexible water conduits in order to operate the solenoid valves.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
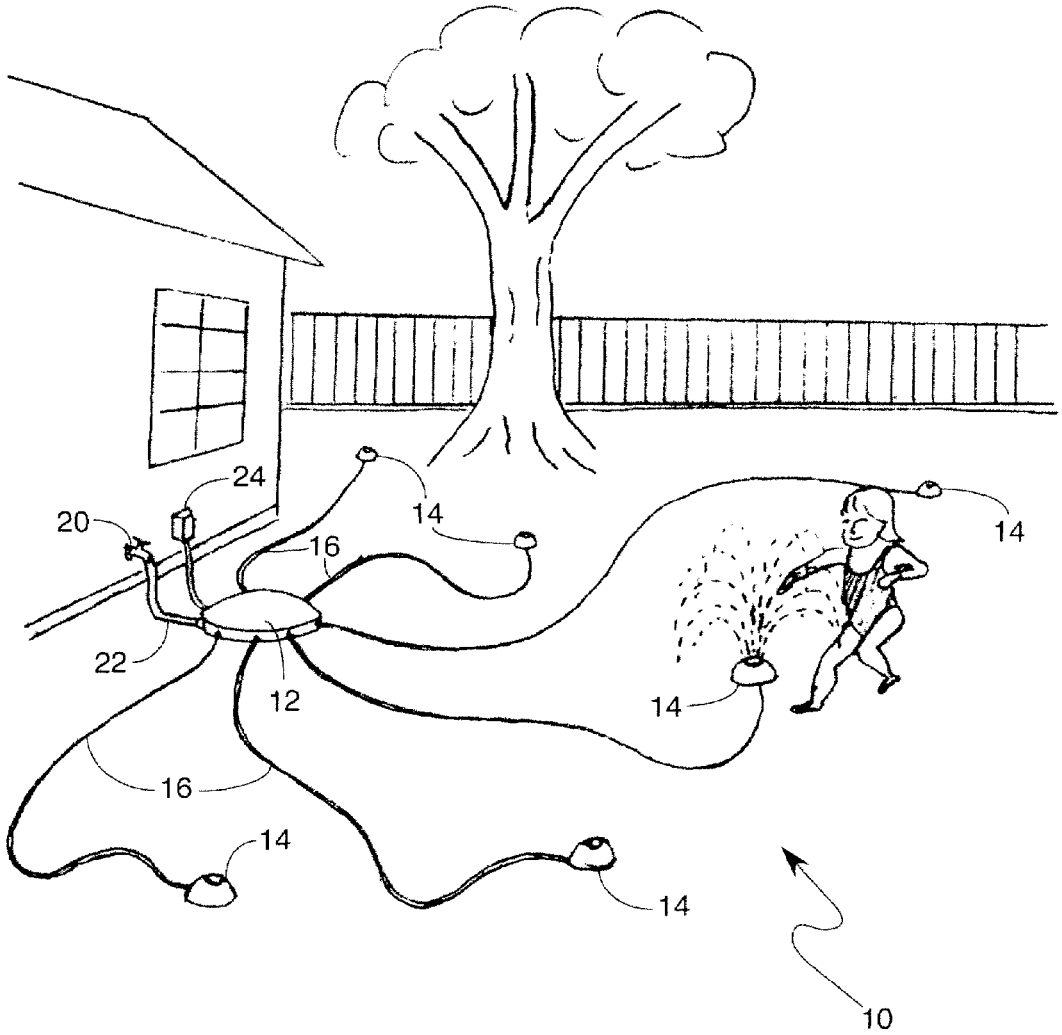
FIG. 1 illustrates a sprinkler play apparatus in accordance with an embodiment of the present invention.

FIG. 1 provides an overview of a sprinkler play apparatus 10 in accordance with an embodiment of the present invention. The apparatus includes a central distribution station 12 and a plurality of sprinkler stations 14. The sprinkler stations are connected to the distribution station by flexible water conduits 16. It is preferred that each of the sprinkler stations include a solenoid-operated valve. Placing the valve within the sprinkler station itself maintains water pressure within the flexible conduit and thereby allows for a near instantaneous spray of water when the valve is activated. The solenoid may be energized by battery power within the sprinkler station itself or by means of electrical conductors connected to the distribution station. In this latter case, the conductors may be routed with or made an integral part of the flexible water conduits. The distribution station 12 is connected to a hose bib 20 by a length of garden hose 22. In embodiments where power for valve operation is supplied from the distribution station, the distribution station is coupled to a low voltage power supply 24.

The distribution station and each of the sprinkler stations may have a padded covering to reduce the possibility of injury in the event that a child falls on one of the stations. The covering may comprise, for example, vinyl padding of the type widely used for swimming pool floats. In addition, the distribution and sprinkler stations have a dome or cone-shaped outer configuration to provide for sufficient padding. The spray nozzles located in the sprinkler stations are preferably recessed below the upper surface to further reduce the possibility of injury in the event of a fall.

Figure 2:
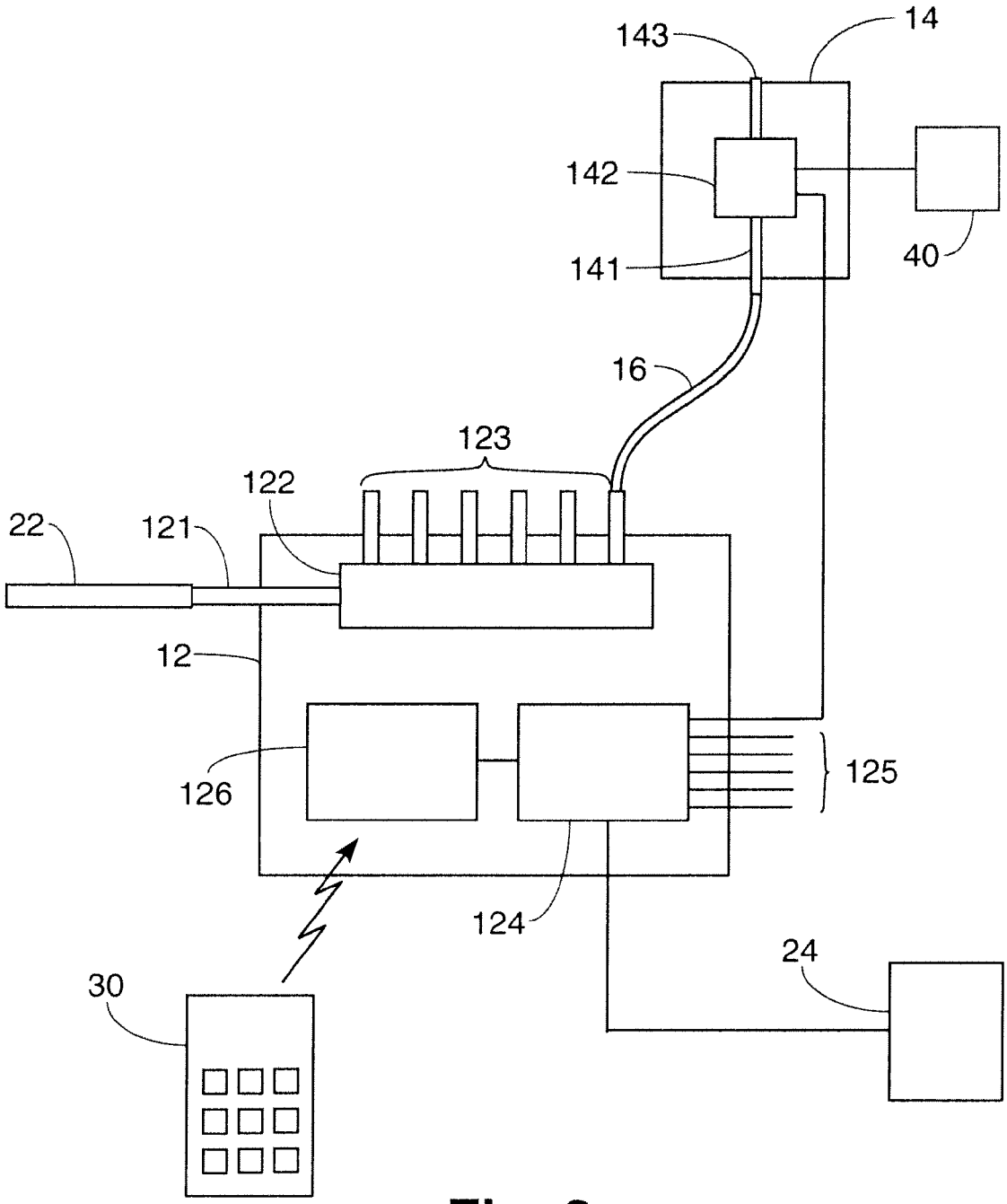
FIG. 2 is a block diagram of the sprinkler play apparatus shown in FIG. 1.

FIG. 2 is a functional block diagram of sprinkler play apparatus 10. Distribution station 12 has a water inlet 121 to which hose section 22 attaches. The water inlet 121 is in fluid communication with water manifold 122, which has a plurality of outlets 123. The flexible water conduits 16 connect to respective ones of the manifold outlets 123. In this embodiment, distribution station 12 receives electrical power from low voltage supply 24. The power is connected to sprinkler controller 124, which has a plurality of outputs 125 for controlling the individual sprinkler stations. Operation of the sprinkler stations may be manually controlled directly at the distribution station; however, it is desirable that the sprinkler stations be remotely controlled. For this purpose, distribution station 12 includes a remote control receiver module 126 for receiving commands from a portable remote control 30. Communications between the remote control unit 30 and receiver 126 may be via radio frequency (RF) or infrared (IR). Commands are appropriately decoded within receiver module 126 and delivered to controller 124.

Each of sprinkler stations 14 has a water inlet 141 to which a respective flexible water conduit 16 is coupled. Solenoid-operated valve 142 it is normally closed to prevent the discharge or water. When energized by a corresponding output 125, the solenoid-operated valve opens and allows water to be discharged through one or more spray nozzles or orifices 143. Different types of nozzles may be installed in different sprinkler stations to provide a variety of water spray patterns.

The remote control 30 is operated by a parent or one of the children to turn the individual sprinkler stations on and off. Children like to run from one sprinkler station to another as they are turned on. They also like to run around the different stations and guess which sprinkler station will be turned on next. The control unit may include a program that randomly turns the sprinkler stations on and off. The control unit may also include a timer circuit to limit the amount of time that any of the sprinkler stations may be left on.

The play apparatus may include a motion sensor 40 for one or more of the sprinkler stations. This allows the sprinkler station to be optionally activated in response to detected motion, such as a child approaching the station.

Figure 3:
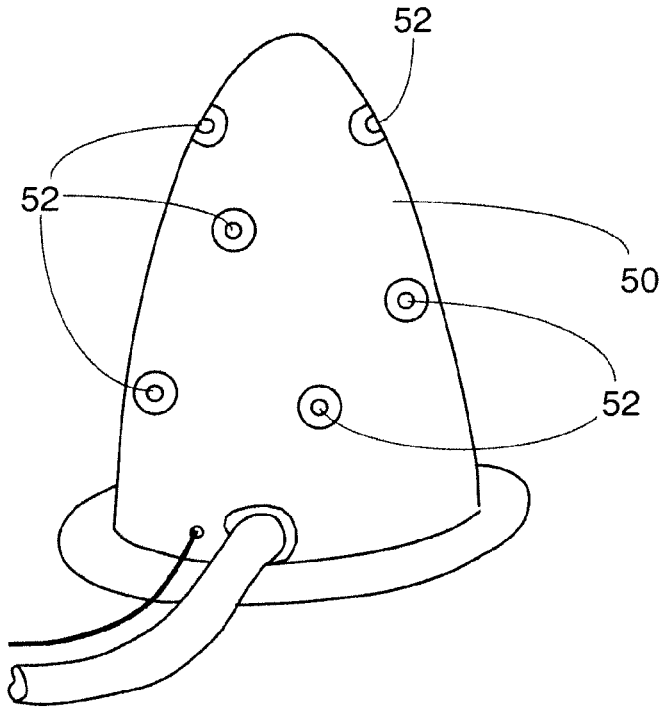
FIG. 3 illustrates a sprinkler play apparatus in accordance with another embodiment of the present invention.

FIG. 3 shows a sprinkler spray apparatus 50 in accordance with an alternative embodiment of the invention. In this case, a plurality of spray nozzles 52 are located in a single cone-shaped housing. Here again, a remote control or random program is used to select which of the nozzles water will be sprayed from.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A sprinkler play apparatus comprising:

a distribution station with a water inlet and a plurality of water outlets;

a plurality of sprinkler stations connected to respective ones of the water outlets with flexible water conduits such that the sprinkler stations may be arranged at spaced apart locations on a play surface, each of the sprinkler stations including a spray nozzle located therein and a remotely controlled valve located at the respective sprinkler station;

a control unit for selectively activating the valves;

wherein the distribution station and sprinkler stations are configured to be set up non-permanently on the play surface.

2. The sprinkler play apparatus of claim 1 wherein the valves are electrically activated.

3. The sprinkler play apparatus of claim 1 wherein the flexible water conduits include electrical conductors electrically connecting the valves to the distribution station.

4. The sprinkler play apparatus of claim 1 wherein the sprinkler stations are covered with a cushioning material.

5. The sprinkler play apparatus of claim 1 wherein at least two of the sprinkler stations have different spray patterns.

6. The sprinkler play apparatus of claim 1 wherein the control unit includes a timer for limiting activation of a sprinkler station to a predetermined period of time.

7. The sprinkler play apparatus of claim 1 further comprising a motion sensor.

8. The sprinkler play apparatus of claim 7 wherein a sprinkler station is activated in response to a signal from the motion sensor.

9. The sprinkler play apparatus of claim 7 wherein all sprinkler stations are deactivated if motion is not sensed for a predetermined period of time.

10. The sprinkler play apparatus of claim 1 wherein the control unit is operable to selectively activate each of the sprinkler stations.

11. The sprinkler play apparatus of claim 1 wherein the control unit is remotely operated.

12. The sprinkler play apparatus of claim 11 wherein the control unit turns off all sprinkler stations when the control unit has not been remotely operated for a predetermined period of time.

13. The sprinkler play apparatus of claim 1 wherein the control unit includes means for activating the sprinkler stations in a random pattern.

14. The sprinkler play apparatus of claim 1 wherein the water inlet is configured to connect to a garden hose fitting.

* * * * *